US008074408B1

(12) United States Patent
Motosko et al.

(10) Patent No.: US 8,074,408 B1
(45) Date of Patent: Dec. 13, 2011

(54) STORM REINFORCING BRACE FOR A CORRUGATED HURRICANE SHUTTER AND SYSTEM

(76) Inventors: Stephen J. Motosko, Sarasota, FL (US); Stephen Motosko, III, Sarasota, FL (US)

( * ) Notice: Subject to any disclaimer, the term of this patent is extended or adjusted under 35 U.S.C. 154(b) by 232 days.

(21) Appl. No.: 12/429,816

(22) Filed: Apr. 24, 2009

(51) Int. Cl.
*E06B 3/30* (2006.01)
*E06B 3/26* (2006.01)
*E06B 9/02* (2006.01)

(52) U.S. Cl. ..... 52/202; 52/798.1; 52/745.16; 52/784.1; 49/61; 49/62; 49/57

(58) Field of Classification Search ..... 52/202, 52/309.1, 814, 506.05, 798.1, 795.1, 797.1, 52/309, 16, 204.5, 204.6, 204.7, 208, 203, 52/537, 783.11–783.15, 784.1, 746.1, 506.06, 52/783.19, 309.16, 200, 579; 49/62, 463, 49/464, 55, 57, 61, 364, 49, 50, 124, 501; 160/225, 228
See application file for complete search history.

(56) References Cited

U.S. PATENT DOCUMENTS

| | | | | |
|---|---|---|---|---|
| 1,633,848 | A | 6/1927 | Dandridge | |
| 2,622,285 | A | 12/1952 | Roos | |
| 2,777,174 | A | 1/1957 | Carr | |
| 3,685,230 | A * | 8/1972 | Lickliter et al. | 52/677 |
| 5,383,315 | A | 1/1995 | Birs | |
| 5,457,921 | A * | 10/1995 | Kostrzecha | 52/202 |
| 5,540,018 | A * | 7/1996 | Biggers | 52/202 |
| 5,669,190 | A * | 9/1997 | Szyjkowski | 52/196 |
| 5,740,639 | A * | 4/1998 | Covington | 52/202 |
| 5,787,642 | A * | 8/1998 | Coyle et al. | 49/61 |
| 5,899,041 | A * | 5/1999 | Durin | 52/660 |
| 5,996,292 | A * | 12/1999 | Hill et al. | 52/202 |
| 6,079,168 | A * | 6/2000 | Shaver | 52/202 |
| 6,189,264 | B1 | 2/2001 | DiVeroli | |
| 6,330,768 | B1 | 12/2001 | Rodrigues | |
| 6,590,154 | B1 * | 7/2003 | Badey et al. | 174/480 |
| 6,640,509 | B2 | 11/2003 | Clewis | |
| 7,025,223 | B2 * | 4/2006 | Hamm | 220/485 |
| 7,832,175 | B2 * | 11/2010 | Powers | 52/745.05 |
| 2003/0000160 | A1 * | 1/2003 | Germain | 52/202 |
| 2005/0166492 | A1 * | 8/2005 | Schiedegger et al. | 52/202 |
| 2006/0010792 | A1 * | 1/2006 | Biggers | 52/202 |
| 2006/0021290 | A1 * | 2/2006 | Kobrehel et al. | 52/202 |
| 2006/0179737 | A1 * | 8/2006 | Trundle | 52/202 |

(Continued)

*Primary Examiner* — Jeanette E. Chapman
(74) *Attorney, Agent, or Firm* — Gifford, Krass, Sprinkle, Anderson & Citkowski, P.C.

(57) ABSTRACT

A storm reinforcing brace for a corrugated polycarbonate plastic hurricane shutter panel, and the combination thereof. The brace includes an elongated bar member extrusion-formed as a single one-piece unit and having a continuous, uniform generally hat-shaped section defining a central portion, leg or side portions, and mounting flange portions thereof. The central portion is preferably flat with an inwardly extending C-shaped channel sized to entrappingly slidably receive a head of a separate threaded fastener from either end of the channel, the threaded fastener being held in the channel in an outwardly extending adjustably slidable orientation along the length of the brace. Each of the mounting flange portions lie in a plane inwardly offset from the central portion and laterally extending from each corresponding leg portion, each of the mounting flange portions for receiving fasteners therethrough anchoring the brace against the upright side members of a window frame. The central portion is offset from the plane of the mounting flanges a distance sufficient for the central portion to support an inner planar surface of the shutter panel, the threaded fastener passing through the shutter panel to boltably secure the shutter panel against the central surface.

8 Claims, 6 Drawing Sheets

U.S. PATENT DOCUMENTS

2006/0230695 A1* 10/2006 Swergold ..... 52/202
2007/0107328 A1* 5/2007 Munch ..... 52/202
2008/0141600 A1* 6/2008 Coffey ..... 52/204.53
2009/0288352 A1* 11/2009 Wenrick et al. ..... 52/202

* cited by examiner

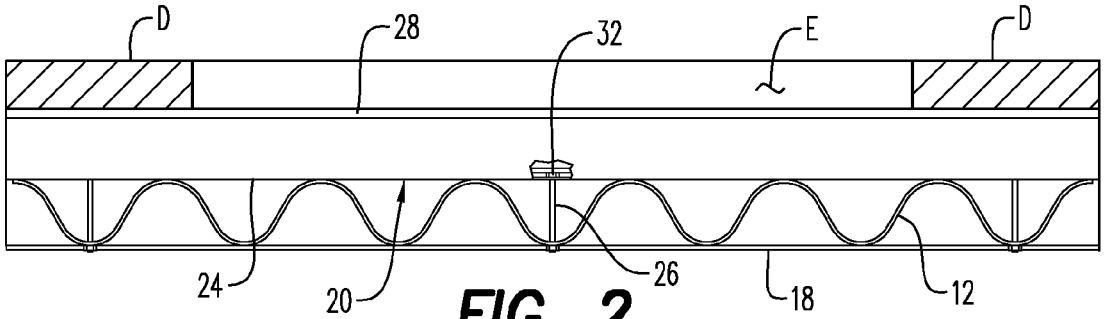
FIG. 2
FIG. 2A
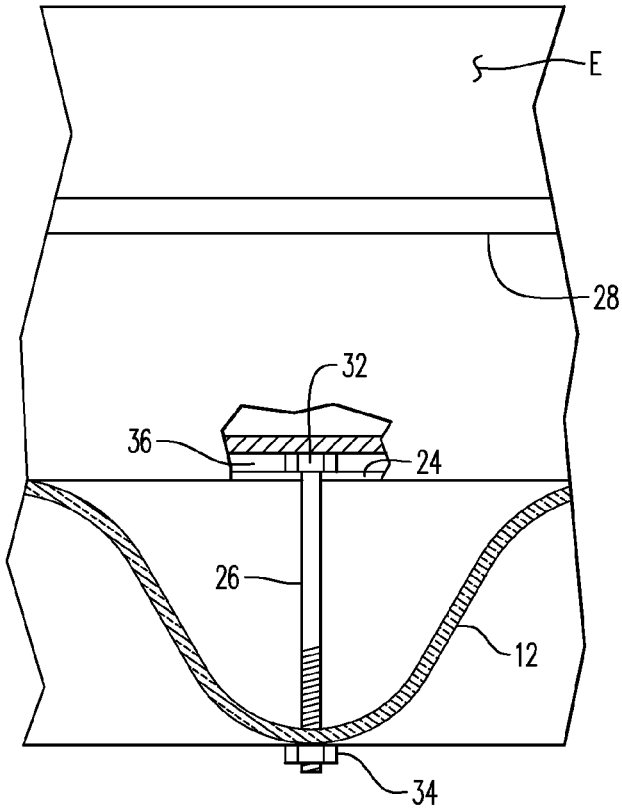

STORM REINFORCING BRACE FOR A CORRUGATED HURRICANE SHUTTER AND SYSTEM

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to removable storm and hurricane shutters and more particularly to a storm reinforcing brace for corrugated hurricane shutters.

2. Description of Related Art

Hurricane shutters have become extremely popular and useful in the hurricane prone sections of the country. Such hurricane shutters are typically deployed prior to an area coming under the influence tropical storm and hurricane weather conditions and serve to prevent damage to the glass windows and portal doors as a result of high winds and flying debris. An example of such a storm shutter installation is disclosed in U.S. Pat. No. 4,685,261 which is primarily directed to a hurricane shutter which includes a lower support channel or bracket which is readily adaptable to a range of lower sill angles to which this portion of the storm shutter is attached.

Following are a number of prior art references which teach means for reinforcing window and door protective devices. U.S. Pat. No. 2,622,285 to Roos discloses a means to protect windows. Birs teaches a hurricane shutter reinforcement and method in U.S. Pat. No. 5,383,315.

A window barrier is taught by Dandridge in U.S. Pat. No. 1,633,848. Carr discloses a combination storm shutter and fastener in U.S. Pat. No. 2,777,174.

U.S. Pat. No. 6,330,768 to Rodrigues teaches a window storm panel brace. A bracing device for a storm panel is also disclosed by Clewis in U.S. Pat. No. 6,640,509.

DiVeroli discloses a storm panel system in U.S. Pat. No. 6,189,264. A hurricane shutter apparatus for installation in a building during its original construction is taught by Biggers in U.S. Patent Application Publication 2006/0010792.

The foregoing examples of the related art and limitations related therewith are intended to be illustrative and not exclusive. Other limitations of the related art will become apparent to those skilled in the art upon a reading of the specification and a study of the drawings.

The present invention affords a simple, easy to install hurricane reinforcing brace particularly adapted to strengthen corrugated plastic or metal hurricane panels across the mid-section of such panels, typically the weakest area for resisting airborne flying objects during tropical storms and hurricane force winds. The invention is easily attachable to the window frame and likewise, easily interengageable with the corrugated hurricane shutter after the reinforcing brace has been installed.

BRIEF SUMMARY OF THE INVENTION

This invention is directed to a storm reinforcing brace for a corrugated preferably polycarbonate plastic hurricane shutter panel, and the combination thereof. The brace includes an elongated bar member extrusion-formed as a single one-piece unit and having a continuous, uniform generally hat-shaped section defining a central portion, leg or side portions, and mounting flange portions thereof. The central portion is preferably flat with an inwardly extending C-shaped channel sized to entrappingly slidably receive a head of a separate threaded fastener from either end of the channel, the threaded fastener being held in the channel in an outwardly extending adjustably slidable orientation along the length of the brace. Each of the mounting flange portions lie in a plane inwardly offset from the central portion and laterally extending from each corresponding leg portion, each of the mounting flange portions for receiving fasteners therethrough anchoring the brace against the upright side members of a window frame. The central portion is offset from the plane of the mounting flanges a distance sufficient for the central portion to support an inner planar surface of the shutter panel, the threaded fastener passing through the shutter panel to boltably secure the shutter panel against the central surface.

It is therefore an object of this invention to provide a storm reinforcing brace for strengthening corrugated hurricane shutters during hurricane and tropical storm conditions.

It is another object of this invention to provide an easily installable storm reinforcing brace which extends transversely or horizontally across the mid-section of a plastic corrugated hurricane shutter to strengthen this area from flying object impact during hurricane force winds.

Yet another object of this invention is to provide an extgruded one-piece storm reinforcing brace which is easily attachable to the side or upright portions of a window frame and which is then easily boltably interengageable with a corrugated hurricane shutter formed of various materials, the brace adding substantially to the impact resistance strength of the hurricane panel.

In accordance with this and other objects which will become apparent hereinafter, the instant invention will now be described with reference to the accompanying drawings.

BRIEF DESCRIPTION OF THE SEVERAL VIEWS OF THE DRAWING(S)

FIG. 2 is a section view in the direction of arrows 2-2 in FIG. 1.

FIG. 2A is an enlarged broken view of the central portion of FIG. 2.

Figure 1:
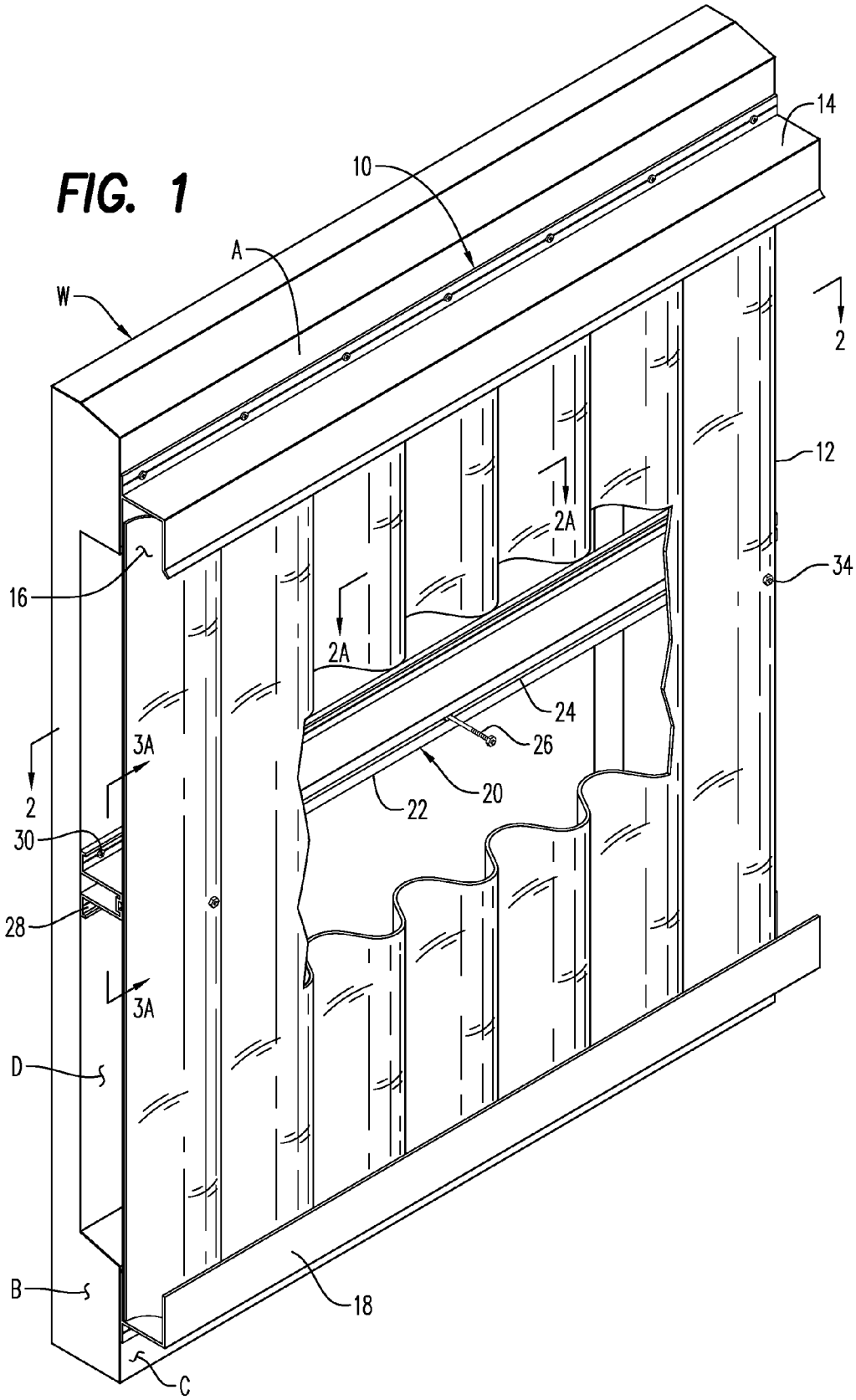
FIG. 1 is a perspective broken view of the invention shown in place attached to a window frame and supporting a conventional corrugated polycarbonate hurricane shutter.

Exemplary embodiments are illustrated in reference figures of the drawings. It is intended that the embodiments and figures disclosed herein are to be considered to be illustrative rather than limiting.

DETAILED DESCRIPTION OF THE INVENTION

Referring now to the drawings, and firstly to FIGS. 1 to 6, a typical corrugated hurricane shutter installation of the present invention is there shown generally at numeral 10. The corrugated hurricane shutter 12 envisions conventional and well-known hurricane shutter structural aspects including opaque and light transmitting features and various metal and plastic materials, the light transmitting panels preferably being of a corrugated polycarbonate plastic construction.

The hurricane shutter 12 includes corrugations and is supported at the upper end within a generally inverted U-shaped pocket 16 of an upper extruded aluminum header bar 14 which is attached by fasteners to the upper frame A of a window frame W. The lower end of the hurricane shutter 12 is supported and retained within a U-shaped lower support channel 18 attached to the lower horizontal frame C of the window frame W.

Figure 5:
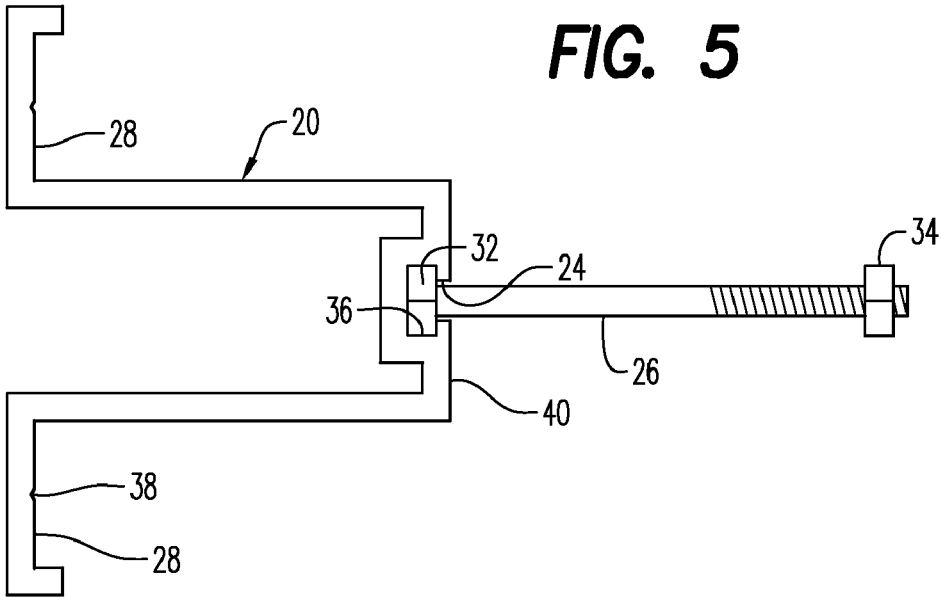
FIG. 5 is an end elevation view of FIG. 4.
Figure 6:
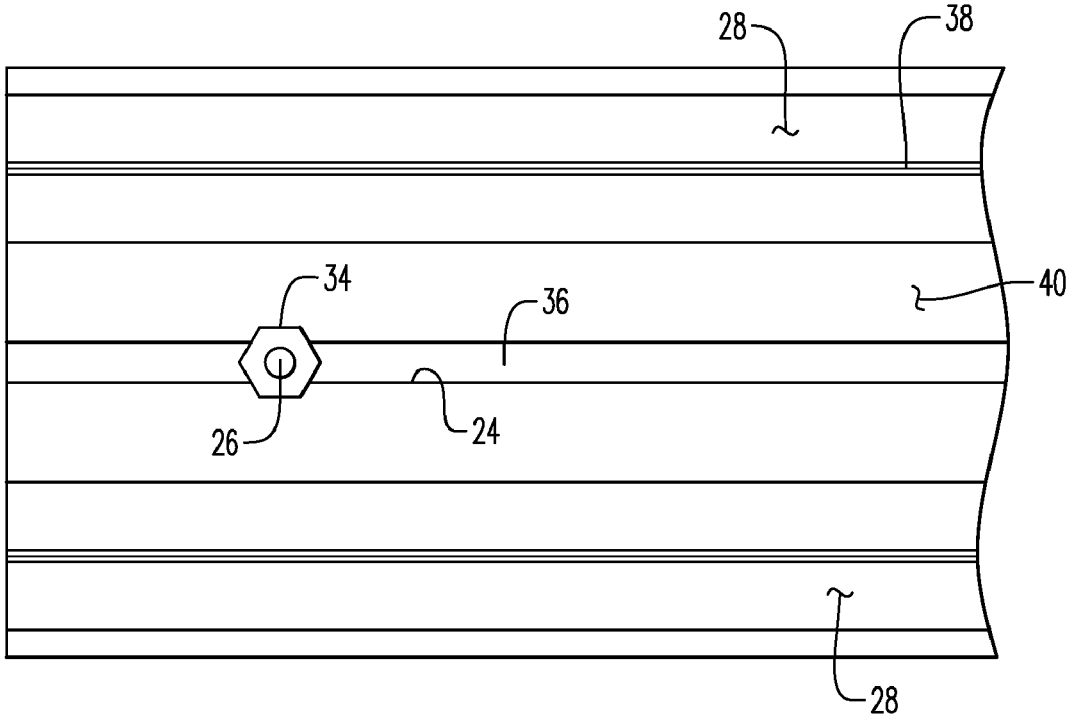
FIG. 6 is a front elevation view of FIG. 4.

A storm reinforcing brace shown generally at numeral 20 is attached by mechanical fasteners 30 at each end thereof to the upright side portions D of the window frame W. As best seen in FIG. 5, the reinforcing brace 20 is formed of an aluminum extrusion having a generally hat-shaped uniform cross-sectional configuration. The brace 20 includes a central portion 40 which is preferably flat and having an inwardly extending C-shaped channel 36 inwardly extending from the outer surface of the central portion 40. A continuous slot 24 defines the opening of the C-shaped channel 36 which is sized to slidably receive the head 32 of an elongated threaded fastener 26, the shank of the fastener 26 slidably fitting through slot 24. As best understood from FIGS. 1 and 4, each of the threaded fasteners 26 may be slidably inserted into either end of the channel 36 and is slidably positionable along the entire length of the channel 36 as desired.

Parallel side portions of the reinforcing brace 20 extend from the central portion 40 to flanges 28, the flanges 28 having a mounting surface positionable against the upright side portions D of the window frame W. To facilitate proper placement of holes to be drilled into the flanges 28 for mounting purposes, a drilling groove 38 is formed therealong positioned mid-way across the width of each of the flanges 28.

Once the reinforcing brace 20 has been properly drilled so as to provide holes which are generally in alignment over the central portion of each of the upright side portions D of the window frame W, threaded fasteners 30 are secured into the upright side portions D as facilitated by the outturned configuration of these mounting flanges 28. Thereafter, the corrugated hurricane shutter is inserted into the downwardly facing opening 16 of the upper header 14, after which the lower header 18 is secured to the lower horizontal frame C of a window frame W.

Figure 3:
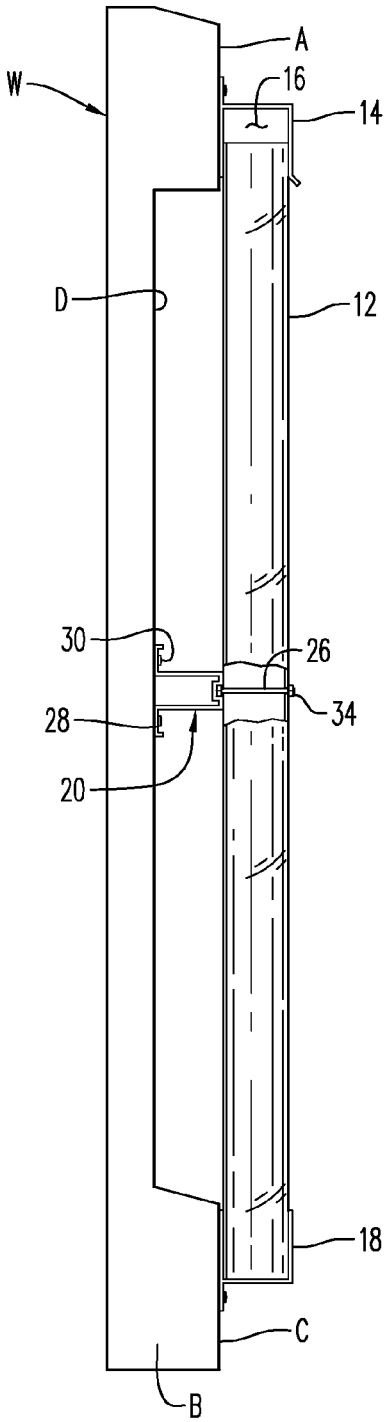
FIG. 3 is a side elevation broken view FIG. 1.
Figure 3A:
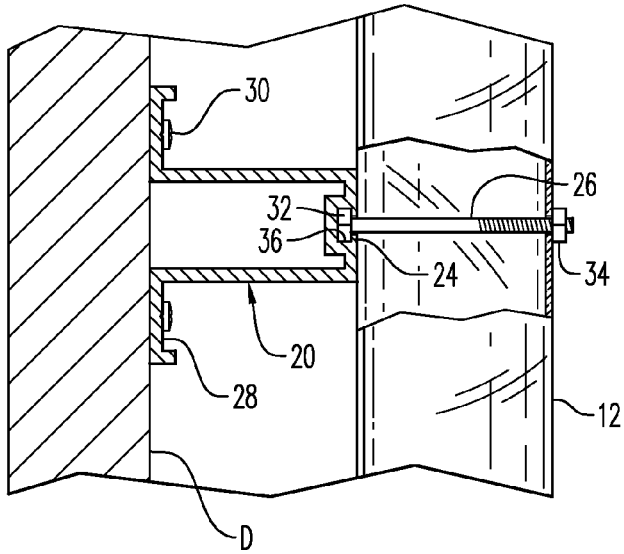
FIG. 3A is an enlargement of the central area of FIG. 3.
Figure 4:
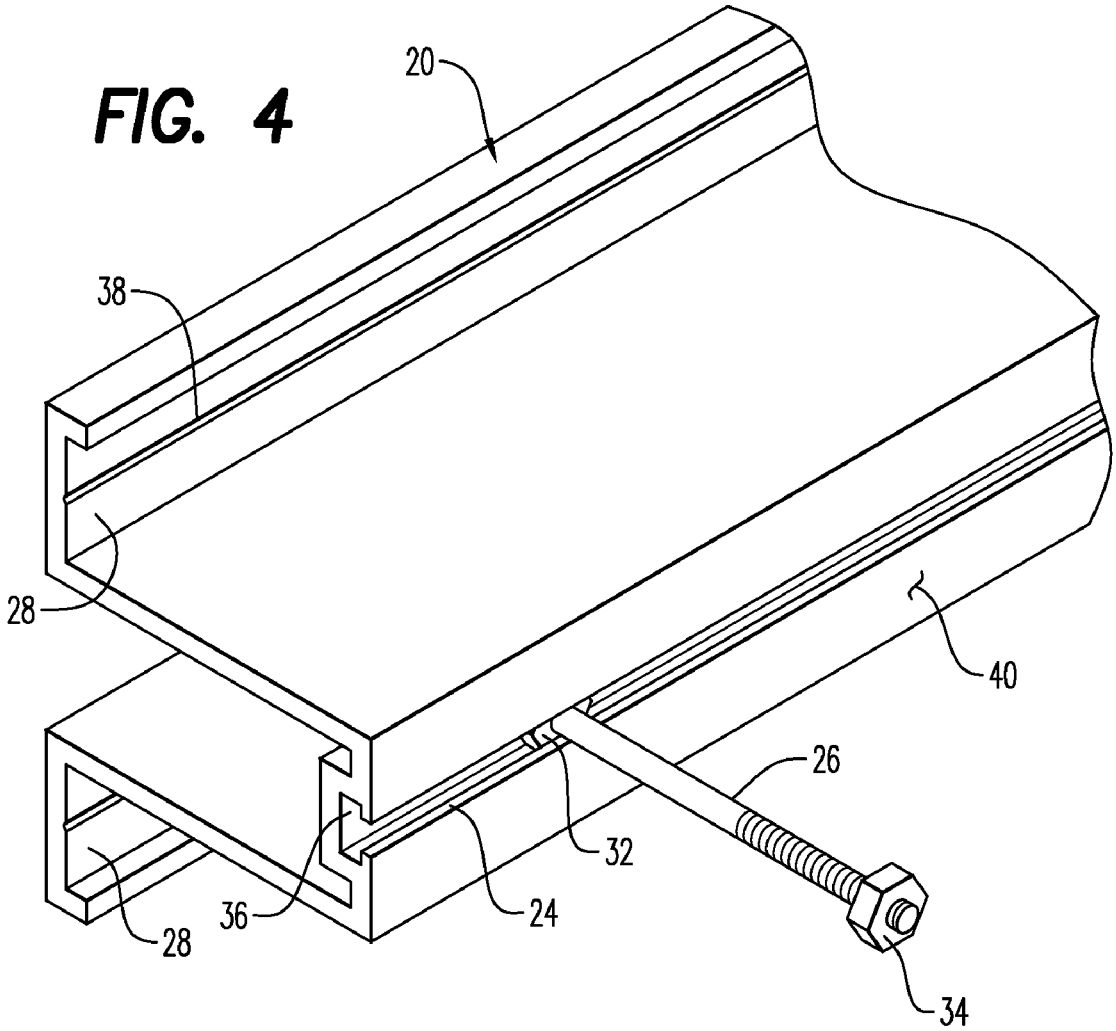
FIG. 4 is a perspective view of one end of the hurricane brace of FIG. 1.

In conjunction with securement of the lower header bar 18, one or more, preferably three, of the elongated threaded fasteners 26 are slidably engaged into channel 36 and moved into alignment with mounting holes H seen in FIG. 3A formed through the outermost peaks of one or more adjacent or spaced apart corrugations of the hurricane panel 12. The threaded end of each of the threaded fasteners 26 is then fitted through the corresponding mounting hole H and a locknut 34 is then threadably engaged into a snuggly tightened position on the threaded fastener 26 against the hurricane panel 12.

Figure 7:
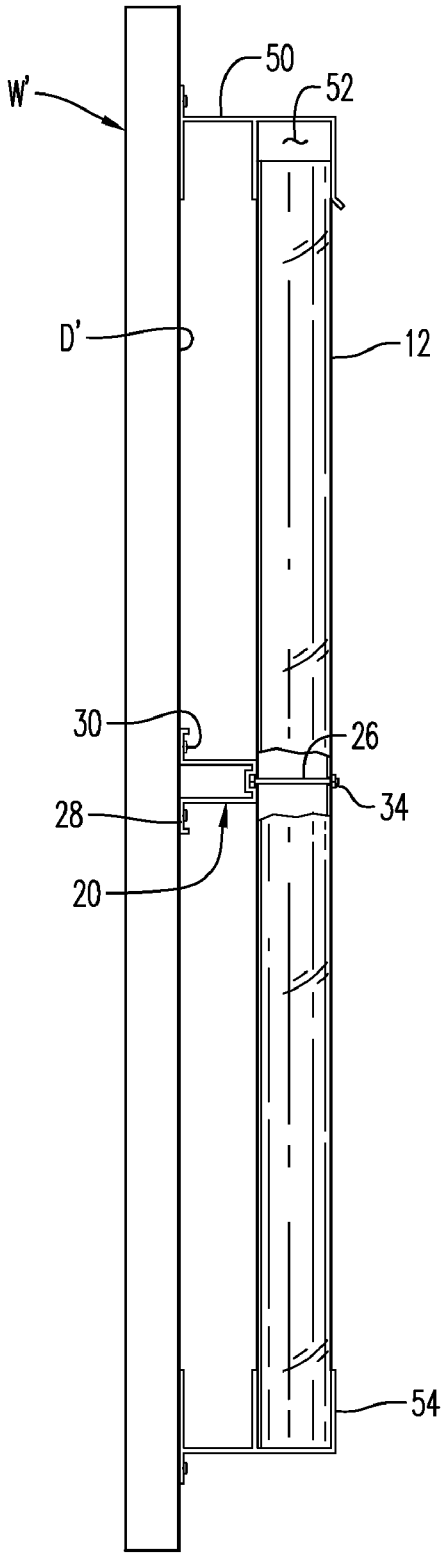
FIG. 7 is a view similar to FIG. 3 showing an alternate embodiment of the invention to accommodate a non-offset window frame installation.

Note that in this embodiment of the window frame W, the upper and lower horizontal frames A and C are outwardly offset from the upright side portions D. As a result, the overall height of the reinforcing brace 20 accommodates this offset so that the upper and lower header channels 14 and 18 need have no additional offset. However, as seen in FIG. 7, where the window frame W' is completely flush or planar, the upper and lower header bars 50 and 54 must be offset to accommodate the overall height of the reinforcing brace 20.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A storm reinforcement brace that reinforces a hurricane shutter assembly for protecting an opening having an upper frame, a lower frame, and a pair of side frames extending between the upper frame and the lower frame, the hurricane shutter assembly includes a corrugated hurricane shutter panel having a middle section disposed between an upper edge and a lower edge, the hurricane shutter panel being supported over the opening by an elongated header attached to the upper frame and an elongated lower channel attached to the lower frame, said storm reinforcement brace comprising:

an elongated bar member having a generally hat-shaped cross section defining a flat central portion, leg portions, and mounting flange portions, said central portion having an inwardly extending C-shaped channel extending a length of said bar member, said C-shaped channel sized to entrappingly slidably receive a head of a separate threaded fastener from either end of said channel, the threaded fastener being held in said channel in an outwardly extending orientation, said leg portions having a first end and a second end, said first end attached to said central portion and said mounting flange portions extending from said second ends of said leg portions;

said bar member positioned between the elongated header and the lower channel and traversing the opening such that a portion of the mounting flange portions abuts each of the side frames, said central portion abutting an interior surface of the middle section of the hurricane shutter panel to brace the middle section of the hurricane shutter panel against the pair of side frames to reinforce the hurricane shutter panel against deformation.

2. The storm reinforcement brace of claim 1, wherein each of said portions of said mounting flange portions are anchored to one of the pair of side frames.

3. The storm reinforcement brace of claim 2, wherein said threaded fastener passes through an aperture formed in the hurricane shutter panel to boltably secure the hurricane shutter panel against said central portion.

4. A hurricane shutter assembly for protecting an opening of building, the opening being bound by a upper frame, a lower frame and a pair of side frames extending between the upper frame and the lower frame, said hurricane shutter assembly comprising:

an elongated header attached to the upper frame of the opening, said header defining an inverted pocket;

an elongated lower channel attached to the lower frame of the opening, said elongated header defines a pocket;

a corrugated hurricane shutter panel having a middle section disposed between an upper edge and a lower edge, said upper edge received within said inverted pocket of said elongated header, said lower edge received within said pocket of said lower channel, said hurricane shutter panel being supported over the opening by said elongated header and said lower channel; and an reinforcement brace positioned between said header and said lower channel, said brace traversing a width of said hurricane shutter panel and the opening, said brace having a pair of ends, each of said ends secured to one of the pair of side frames, said brace having a flat central portion that abuts an interior surface of said middle section of said hurricane shutter panel to brace said middle section of said hurricane shutter panel against the pair of side frames to reinforce said hurricane shutter panel against deformation.

5. The hurricane shutter assembly of claim 4, wherein said brace includes a pair of leg portions each having a first end and a second end, said first ends connected to either side of said central portion and said second ends having mounting flange portions extending outwardly therefrom.

6. The hurricane shutter assembly of claim 5, wherein said mounting flange portions abut the pair of side frames.

7. The hurricane shutter assembly of claim 6, wherein said central portion includes an inwardly extending C-shaped channel extending a length of said brace, said C-shaped channel sized to entrappingly slidably receive a head of a threaded fastener, the threaded fastener being held in said channel in an outwardly extending orientation;

said hurricane shutter panel having at least one mounting hole for receiving said threaded fastener to secure said central portion of said hurricane shutter panel to said brace.

8. The hurricane shutter assembly of claim 4, wherein said header and said lower channel each include an offset so as to space said hurricane shutter panel apart from said opening by a predetermined distance, and wherein said brace has a height equal to said predetermined distance to reinforce said central portion of said hurricane shutter panel against deformation.

* * * * *